US012364347B2

(12) United States Patent
Lo

(10) Patent No.: US 12,364,347 B2
(45) Date of Patent: Jul. 22, 2025

(54) TILTABLE MIRROR

(71) Applicant: RQ Innovasion Inc., Edmonton (CA)

(72) Inventor: Lenny Kwok Ming Lo, Edmonton (CA)

(73) Assignee: RQ Innovasion Inc., Edmonton (CA)

( * ) Notice: Subject to any disclaimer, the term of this patent is extended or adjusted under 35 U.S.C. 154(b) by 167 days.

(21) Appl. No.: 18/046,210

(22) Filed: Oct. 13, 2022

(65) Prior Publication Data

US 2024/0122380 A1 Apr. 18, 2024

(51) Int. Cl.

| | |
|---|---|
| ***A47G 1/00*** | (2006.01) |
| ***A47G 1/02*** | (2006.01) |
| ***A47G 1/16*** | (2006.01) |

(52) U.S. Cl.

CPC ..... *A47G 1/02* (2013.01); *A47G 1/16* (2013.01); *A47G 2001/002* (2013.01)

(58) Field of Classification Search

CPC ..... A47G 1/00; A47G 2001/002; A47G 2001/005; A47G 1/02; A47G 1/04; A47G 1/16

See application file for complete search history.

(56) References Cited

U.S. PATENT DOCUMENTS

| | | | | |
|---|---|---|---|---|
| 3,708,218 | A * | 1/1973 | Smillie, III | G02B 7/1815 165/47 |
| 11,304,497 | B2 * | 4/2022 | Friedman | A45D 42/18 |
| 11,640,042 | B2 * | 5/2023 | Yang | G02B 7/182 362/135 |
| 11,910,941 | B1 * | 2/2024 | Ehde | A47G 1/1613 |
| 2015/0060431 | A1 * | 3/2015 | Yang | H05B 3/845 62/3.2 |
| 2015/0216331 | A1 * | 8/2015 | Sanchez | A47G 1/02 248/467 |
| 2019/0069702 | A1 * | 3/2019 | Laslo | A47K 10/12 |
| 2021/0364892 | A1 * | 11/2021 | Copeland | F16M 13/022 |
| 2024/0122380 | A1 * | 4/2024 | Lo | A45D 42/16 |

* cited by examiner

*Primary Examiner* — Chi Q Nguyen

(74) *Attorney, Agent, or Firm* — Patterson + Sheridan, LLP

(57) ABSTRACT

An apparatus includes a mirror, a frame, a first magnet, a second magnet, and a third magnet. The mirror is coupled to the frame to form a front surface. The frame includes a back surface opposite the front surface. The back surface includes a first portion, a second portion coupled to the first portion, and a third portion coupled to the second portion. The first portion is angled relative to the second portion. The third portion is angled relative to the second portion. The first magnet is coupled to the first portion. The second magnet is coupled to the second portion. The third magnet is coupled to the third portion.

14 Claims, 7 Drawing Sheets

TILTABLE MIRROR

TECHNICAL FIELD

Embodiments of the present disclosure generally relate to cosmetic products. More specifically, embodiments disclosed herein relate to a tiltable frame for cosmetic products (e.g., a mirror or makeup).

BACKGROUND

Small cosmetic mirrors may be attached to other surfaces (e.g., larger mirrors) to provide a more focused view of a person's face. For example, these cosmetic mirrors may assist the person apply makeup to the person's face.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Overview

Figure 1:
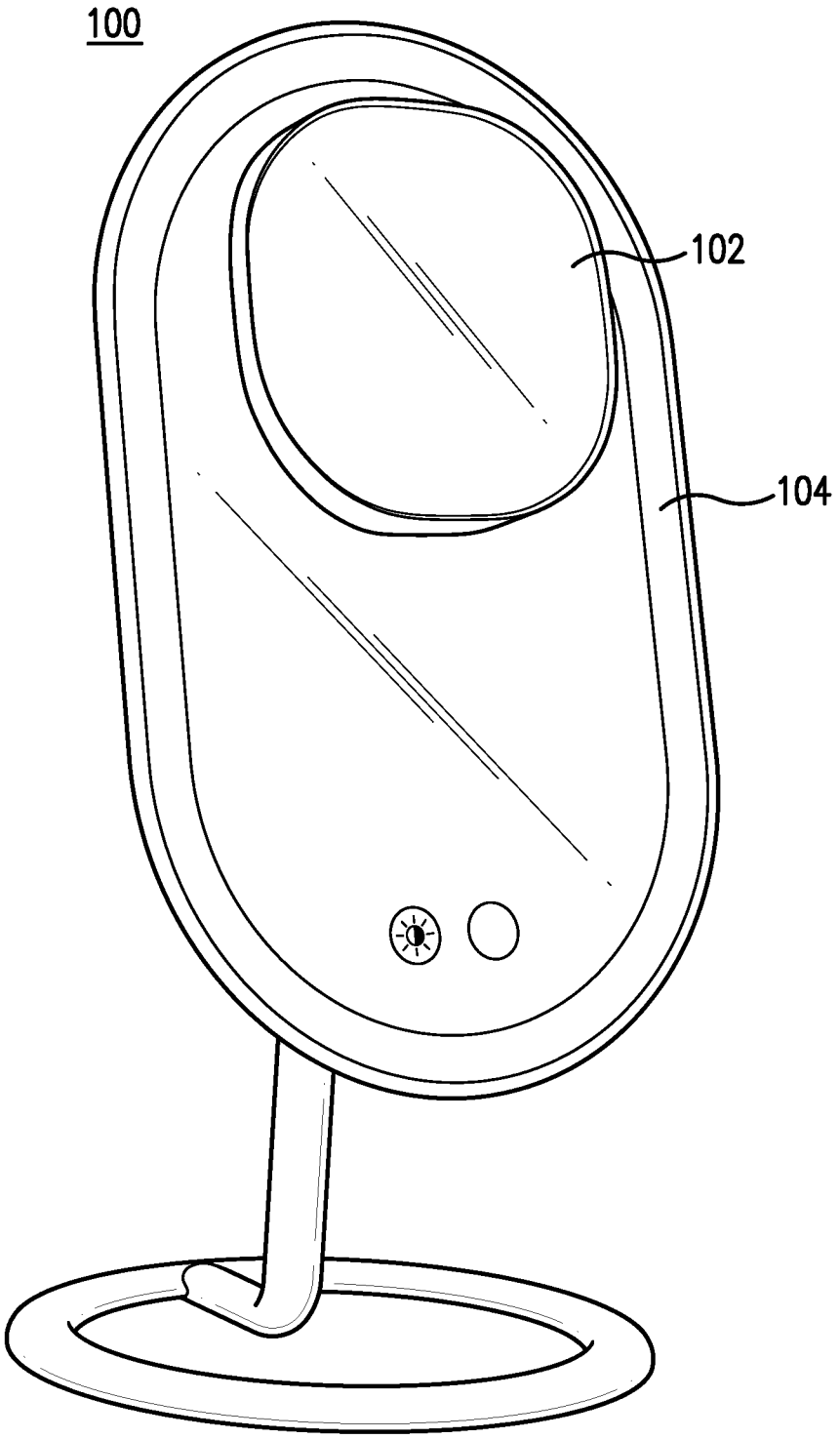
FIG. 1 illustrates an example system.

According to an embodiment, an apparatus includes a mirror, a frame, a first magnet, a second magnet, and a third magnet. The mirror is coupled to the frame to form a front surface. The frame includes a back surface opposite the front surface. The back surface includes a first portion, a second portion coupled to the first portion, and a third portion coupled to the second portion. The first portion is angled relative to the second portion. The third portion is angled relative to the second portion. The first magnet is coupled to the first portion. The second magnet is coupled to the second portion. The third magnet is coupled to the third portion.

According to another embodiment, an apparatus includes a cosmetic product, a frame, a first magnet, a second magnet, and a third magnet. The frame includes a front surface and a back surface opposite the front surface. The cosmetic product is coupled to the front surface. The back surface includes a first portion, a second portion coupled to the first portion, and a third portion coupled to the second portion. The first portion is angled relative to the second portion. The third portion is angled relative to the second portion. The first magnet is coupled to the first portion. The second magnet is coupled to the second portion. The third magnet is coupled to the third portion.

Another embodiment includes a method of operating a device. The device includes a mirror, a frame, a first magnet, a second magnet, and a third magnet. The mirror is coupled to the frame to form a front surface. The frame includes a back surface opposite the front surface. The back surface includes a first portion, a second portion coupled to the first portion, and a third portion coupled to the second portion. The first portion is angled relative to the second portion. The third portion is angled relative to the second portion. The first magnet is coupled to the first portion, the second magnet is coupled to the second portion, and the third magnet is coupled to the third portion. The method includes magnetically attaching, by the second magnet, the second portion to a surface and exerting a force on the mirror or the frame such that the second portion detaches from the surface, such that the first portion magnetically attaches by the first magnet to the surface, and such that the mirror is tilted relative to when the second portion is magnetically attached by the second magnet to the surface.

Example Embodiments

Small cosmetic mirrors may attach to larger surfaces (e.g., a larger mirror). These cosmetic mirrors, however, provide a singular view or perspective of the person's face, which may cause the person to experience difficulty when applying cosmetic products to the person's face. For example, once attached to the larger surface, the cosmetic mirrors may stay pointed in a single direction, which limits the view or perspective provided by the cosmetic mirror.

The present disclosure describes a device with a tiltable frame that can attach to a larger surface (e.g., a larger mirror). Any suitable cosmetic product (e.g., a mirror, magnifying mirror, or makeup) may couple to or engage the tiltable frame. The tiltable frame includes a back surface with different angled portions. Each of the portions may attach to the larger surface (e.g., using magnets). A person may exert a force on the device to attach different portions of the back surface to the larger surface. By switching which portion of the back surface is attached to the larger surface, the tiltable frame changes the angle at which device attaches to the larger surface. As a result, when a mirror is engaged with the frame, changing the angle at which the device attaches to the larger surface changes the view or perspective provided by the mirror. In this manner, the device better assists a person when the person is applying makeup, in certain embodiments.

FIG. 1 illustrates an example system 100. As seen in FIG. 1, the system 100 includes a device 102 and a mirror 104. The device 102 attaches (e.g., magnetically attaches) to the mirror 104. Additionally, the device 102 may be tiltable while remaining attached to the mirror 104. In certain embodiments, tilting the device 102 changes the angle at which the device 102 is directed at a person looking at the device 102 or the mirror 104, which may provide additional views or perspectives.

The device 102 includes a frame that attaches to the mirror 104. The device 102 may attach to any suitable surface (e.g., magnetically attach to a metallic surface behind a reflective surface of the mirror 104). The device 102 may also be detached from the mirror 104 or from any other surface to which the device 102 is attached. When the device 102 is moved close to the mirror 104 or another surface, the device 102 may magnetically attach to the mirror 104 or to the other surface. When the device 102 is pulled away from the mirror 104 or the other surface, the device 102 detaches from the mirror 104 or the other surface.

The device 102 may include a cosmetic product coupled to the frame. For example, the device 102 may include a mirror (e.g., a flat mirror or a magnifying mirror) or a makeup container that couples to the frame. When the frame attaches to the mirror 104 or to another surface, the frame holds the cosmetic product on the surface of the mirror 104 or the other surface. A person may then view or use the cosmetic product that is coupled to the frame. When the device 102 tilts, the device 102 changes the angle at which the cosmetic product is presented.

The frame of the device 102 may include different angled portions that allow the device 102 to transition between different tilted or angled states while remaining attached to the mirror 104 or to another surface. For example, a person may push on the top or bottom of the device 102 to cause the device 102 to attach to the mirror 104 or another surface using another angled surface of the device 102. As a result, the tilt or angle of the device 102 changes, which may provide a different angle perspective or view for the person. The person may exert forces on different parts of the device 102 to change the tilted or angled state of the device 102 (e.g., tilted upward, tilted downward, or front facing). The frame may include any suitable number of angled surfaces that may be used to provide any suitable number of tilted or angled states. For example, each angled surface may allow the device 102 to tilt at a different angle.

Figure 2:
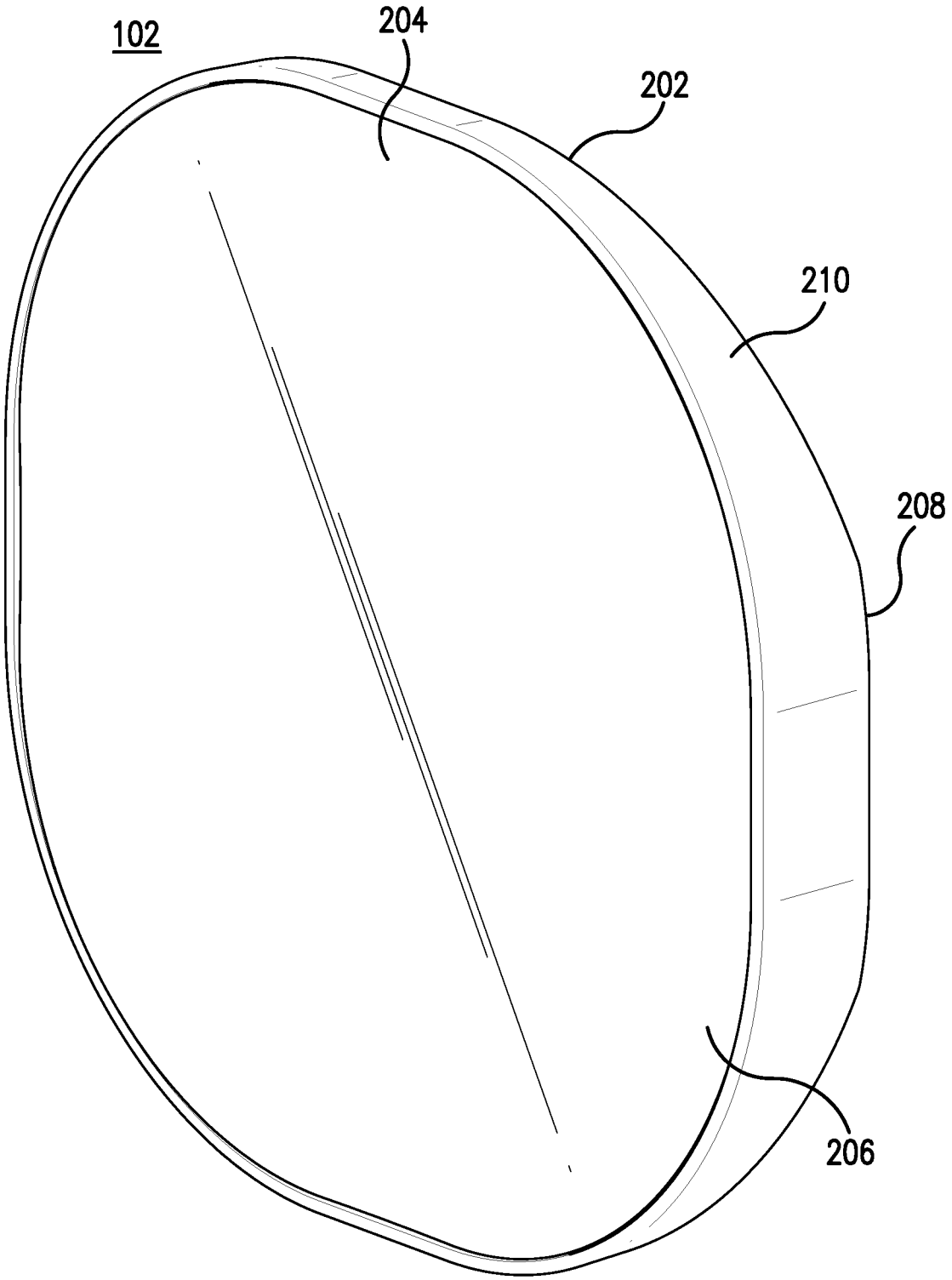
FIG. 2 illustrates an example device in the system of FIG. 1.

FIG. 2 illustrates a front view of an example device 102 in the system 100 of FIG. 1. As seen in FIG. 2, the device 102 includes a frame 202 and a mirror 204. The device 102 may attach to another surface and may be tiltable while remaining attached to that surface.

The frame 202 attaches to other surfaces. In some embodiments, the frame 202 includes one or more magnets that magnetically attach the frame 202 to metal surfaces. Additionally, the frame 202 includes different angled surfaces that allow the frame 202 to tilt, while remaining attached to a surface. The frame 202 may be formed using any suitable material (e.g., plastic, rubber, metal or wood).

The mirror 204 may be positioned within the frame 202 and may couple to the frame 202. The mirror 204 provides a reflective surface that shows a person's face when the person is looking at the mirror 204. In some embodiments, the mirror 204 is a magnifying mirror that provides a magnified view of the person's face. When the device 102 is tilted at different angles, the mirror 204 provides different views or perspectives of the person's face. In this manner, the device 102 provides additional views of the person's face, which assists the person when applying makeup The mirror 204 forms a front surface 206 of the device 102. The frame 202 forms a back surface 208 of the device 102. The front surface 206 is opposite the back surface 208. When the device 102 is attached to a surface, the front surface 206 is directed towards a person looking at the device 102, and the back surface 208 is directed towards the surface to which the device 102 is attached.

The frame 202 also forms the side surface 210. As seen in FIG. 2, the side surface 210 forms a boundary or perimeter of the frame 202 that envelopes or encircles the mirror 204. The side surface 210 may be of any suitable thickness. As a result, the side surface 210 is positioned between the front surface 206 and the back surface 208 and connects the front surface 206 to the back surface 208.

Figure 3:
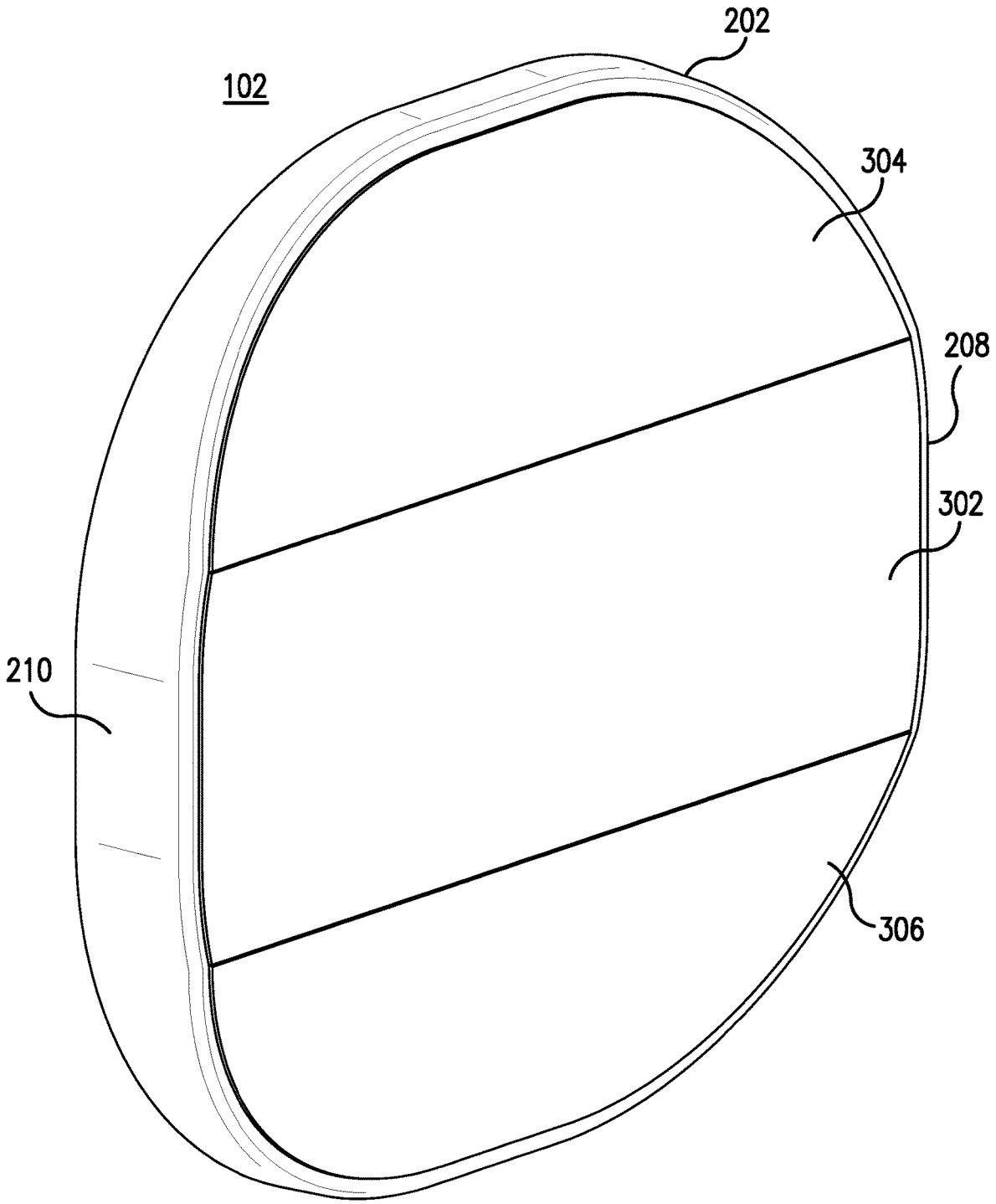
FIG. 3 illustrates an example device in the system of FIG. 1.

FIG. 3 illustrates a back view of an example device 102 in the system 100 of FIG. 1. As see in FIG. 3, the device 102 includes the frame 202, which includes the back surface 208 and the side surface 210. The back surface 208 includes different portions 302, 304, and 306. The portion 302 is positioned between the portions 304 and 306. Additionally, the portions 304 and 306 are angled with respect to the portion 302.

When the device 102 is first attached to a surface, the device 102 may be attached to the surface using the portion 302. When a force is exerted on the top or bottom of the device 102, the portion 302 may detach from the surface, and the portion 304 or the portion 306 may attach to the surface. Because the portions 304 and 306 are angled relative to the portion 302, when the device 102 attaches to the surface using the portions 304 or 306, the device 102 may also tilt relative to when the device 102 attaches to the surface using the portion 302. For example, if a force is exerted on the top of the device 102, the portion 302 may detach from the surface, and the portion 304 may attach to the surface. As a result, the device 102 tilts upwards relative to when the portion 302 was attached to the surface. As another example, if a force is exerted on the bottom of the device 102, the portion 302 may detach from the surface, and the portion 306 may attach to the surface. Because the portion 306 is angled relative to the portion 302, the device 102 may tilt downwards when the portion 306 is attached to the surface relative to when the portion 302 is attached to the surface. In this manner, the device 102 may tilt in different directions while remaining attached to the surface.

As an example operation, a person may bring the device 102 close to a metallic surface and the device 102 may magnetically attach to the surface using the portion 302. In this state, the device 102 may face forward with no tilt. The portion 304 may be positioned above the portion 302, and the portion 306 may be positioned beneath the portion 302. When the person exerts a force on the device 102 near the top of the device 102, the portion 302 may pull away from and detach from the surface, and the portion 304 may move closer to and magnetically attach to the surface. As a result, the device 102 tilts upwards while remaining attached to the surface. When the person exerts a force on the device 102 near the bottom of the device 102, the portion 304 may pull away from and detach from the surface, and the portion 302 may move closer to and magnetically attach to the surface. As a result, the device 102 returns to a forward facing position with no tilt. When the person again exerts a force on the device 102 near the bottom of the device 102, the portion 302 may pull away from and detach from the surface, and the portion 306 may move closer to and magnetically attach to the surface. As a result, the device 102 tilts downwards while remaining attached to the surface. When the person exerts a force on the device 102 near the top of the device 102, the portion 306 may pull away from and detach from the surface, and the portion 302 may move closer to and magnetically attach to the surface. As a result, the device 102 returns to a forward facing position with no tilt.

The device 102 may be rotated so that the device 102 may tilt along any angular position. For example, the device 102 shown in FIG. 3 may be rotated 90 degrees so that the device 102 may tilt to the left or to the right when the portions 304 or 306 are used to attach the device 102 to a surface.

In some embodiments, cushions or other pieces of soft or deformable material may be attached to the portions 302, 304, and 306. For example, foam or rubber pads may be attached to the portions 302, 304, and 306. These pads may provide cushioning so that the device 102 does not damage the surface to which the device 102 is attached when the different portions 302, 304, and 306 of the device 102 detach or attach to the surface.

Figure 4:
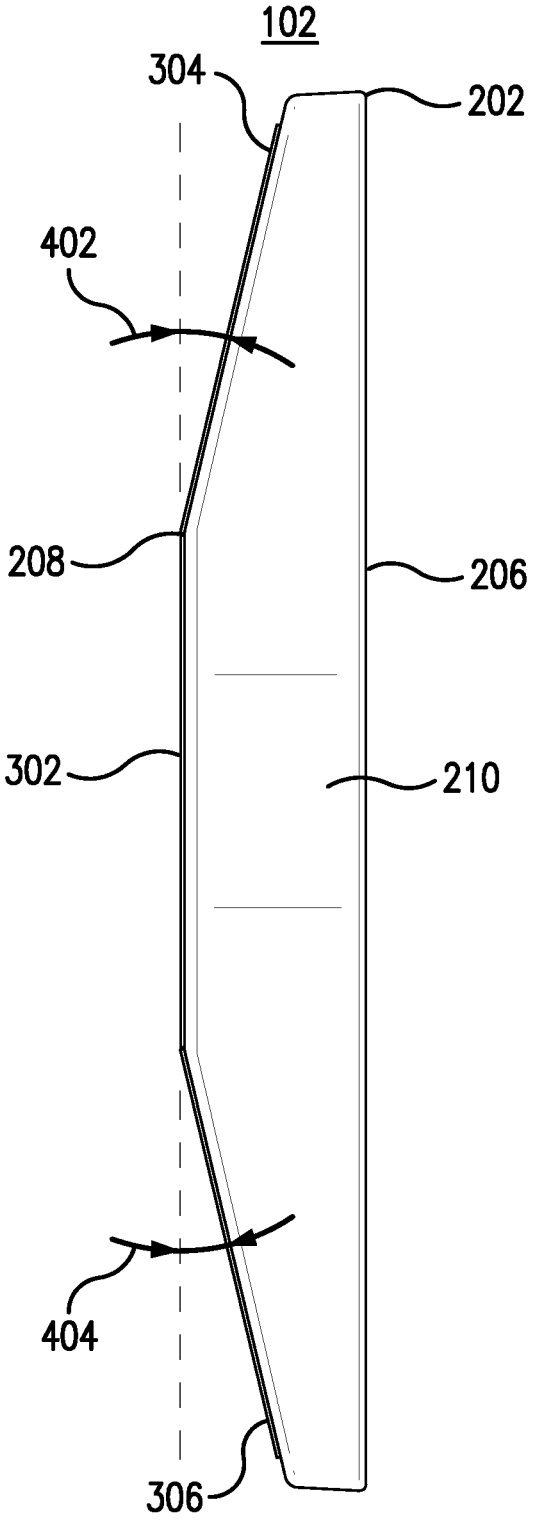
FIG. 4 illustrates an example device in the system of FIG. 1.

FIG. 4 illustrates a side view of an example device 102 in the system 100 of FIG. 1. As seen in FIG. 4, the frame 202 includes the front surface 206, the back surface 208, and the side surface 210. The front surface 206 is opposite the back surface 208. The side surface 210 is positioned between the front surface 206 and the back surface 208. Additionally, the side surface 210 connects the front surface 206 to the back surface 208.

Additionally, the back surface 208 includes the portions 302, 304, and 306. The portion 302 is positioned between the portions 304 and 306. The portion 302 connects the portion 304 to the portion 306.

The portions 304 and 306 are angled relative to the portion 302. In the example of FIG. 4, the portion 304 forms an angle 402 with the portion 302. The portion 306 forms an angle 404 with the portion 302. In some embodiments, the angle 402 and the angle 404 are the same. In certain embodiments, the angle 402 and the angle 404 are not the same. Generally, the greater the angles 402 and 404, the greater the device 102 may be tilted while remaining attached to a surface. The smaller the angles 402 and 404, the less the device 102 may be tilted while remaining attached to the surface. In some embodiments, the size of the angles 402 and 404 may be selected based on the strength of the magnets positioned in the portions 304 and 306. For example, if the magnets are strong, then the angles 402 and 404 may be larger so that the magnets do not pull the portions 304 or 306 too close to an attachment surface and cause the portions 304 or 306 to attach to the surface without any force being exerted by a person onto the device 102.

Figure 5:
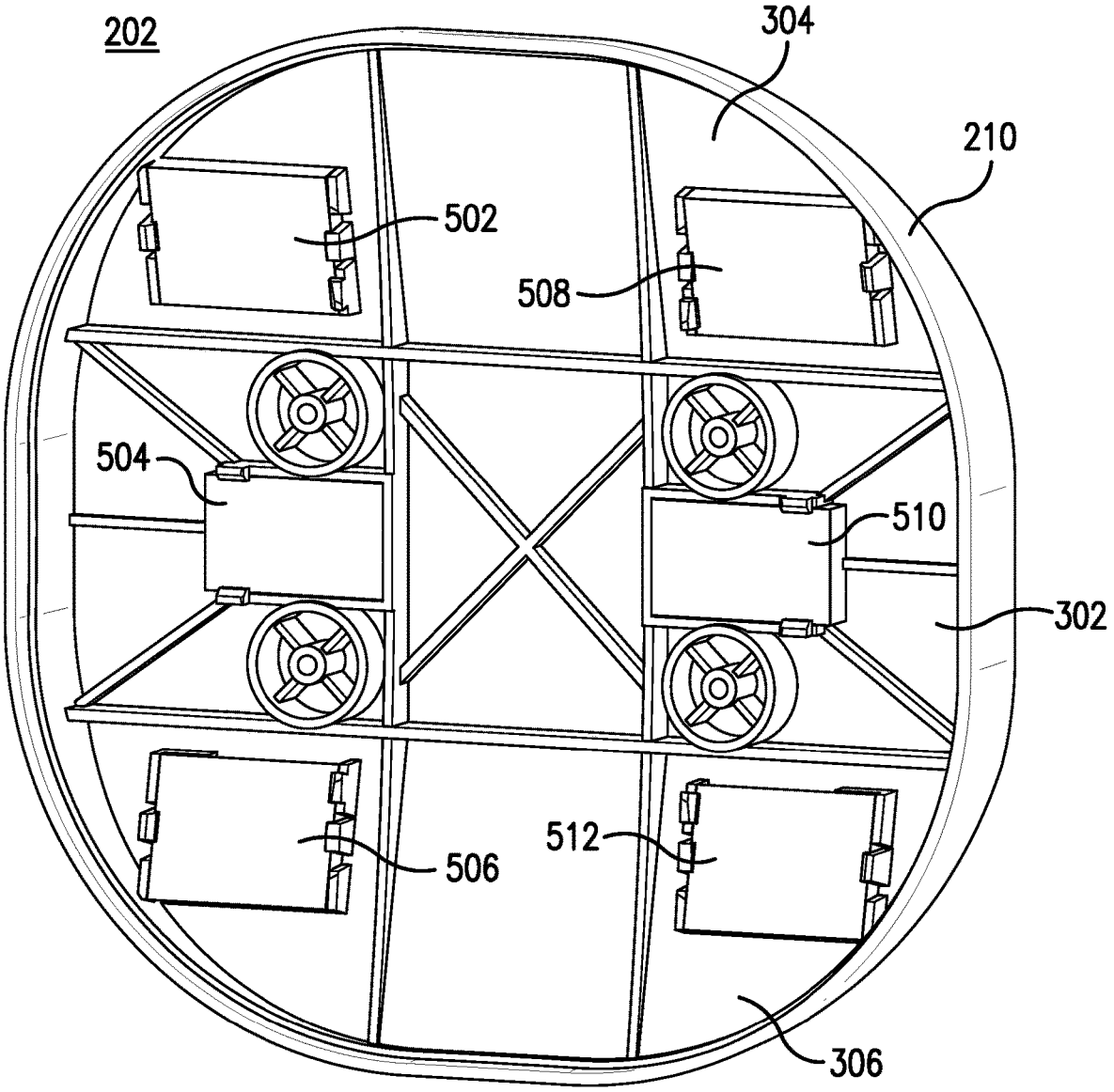
FIG. 5 illustrates an example frame.

FIG. 5 illustrates an example frame 202. Generally, FIG. 5 shows an interior of the frame 202. The frame 202 holds multiple magnets 502, 504, 506, 508, 510, and 512 in the interior of the frame 202. The frame 202 may hold any suitable number of magnets in the interior of the frame 202. These magnets 502, 504, 506, 508, 510, and 512 may be used to magnetically attach the frame 202 to a surface, (e.g., a metallic surface).

In the example of FIG. 5, the portion 302 holds the magnets 504 and 510. The magnets 504 and 510 may be separated from each other to provide a better magnetic attachment when the frame 202 is attached to a surface using the portion 302. The portion 304 holds the magnets 502 and 508. The magnets 502 and 508 may be separated from each other to provide a better magnetic attachment when the portion 304 is attached to a surface. The portion 306 holds the magnets 506 and 512. The magnets 506 and 512 may be separated from each other to provide a better magnetic attachment when the portion 306 is attached to a surface. Additionally, the magnets 502 and 506 may be separated from the magnet 504, and the magnets 508 and 512 may be separated from the magnet 510, so that the magnets 502, 506, 508, and 512 do not interfere or negatively affect the magnetic attachment provided by the magnets 504 and 510 when the portion 302 is attached to a surface. In some embodiments, the magnets 502, 504, 506, 508, 510, and 512 may be selected with particular strengths so that the magnets 502, 504, 506, 508, 510, and 512 do not interfere with the magnetic attachment provided by another magnet 502, 504, 506, 508, 510, and 512.

As an example operation, the frame 202 may be brought close to a surface, such as a metallic surface, and the magnets 504 and 510 may magnetically attach the portion 302 to the surface. When a force is exerted near the portion 304, the portion 302 may detach from and pull away from the surface, and the portion 304 may be brought close to the surface. The magnets 502 and 508 then magnetically attach the portion 304 to the surface, which causes the frame 202 to tilt. When a force is exerted near the portion 306, the portion 304 may detach from and pull away from the surface, and the portion 302 may be brought close to the surface. The magnets 504 and 510 then magnetically attach the portion 302 to the surface. When another force is exerted near the portion 306, the portion 302 detaches from and pulls away from the surface, and the portion 306 is brought near the surface. The magnets 506 and 512 then magnetically attach the portion 306 to the surface, which causes the frame 202 to tilt. In this manner, difference forces may be exerted on the frame 202 to tilt the frame 202, while the frame 202 remains attached to the surface.

Figure 6:
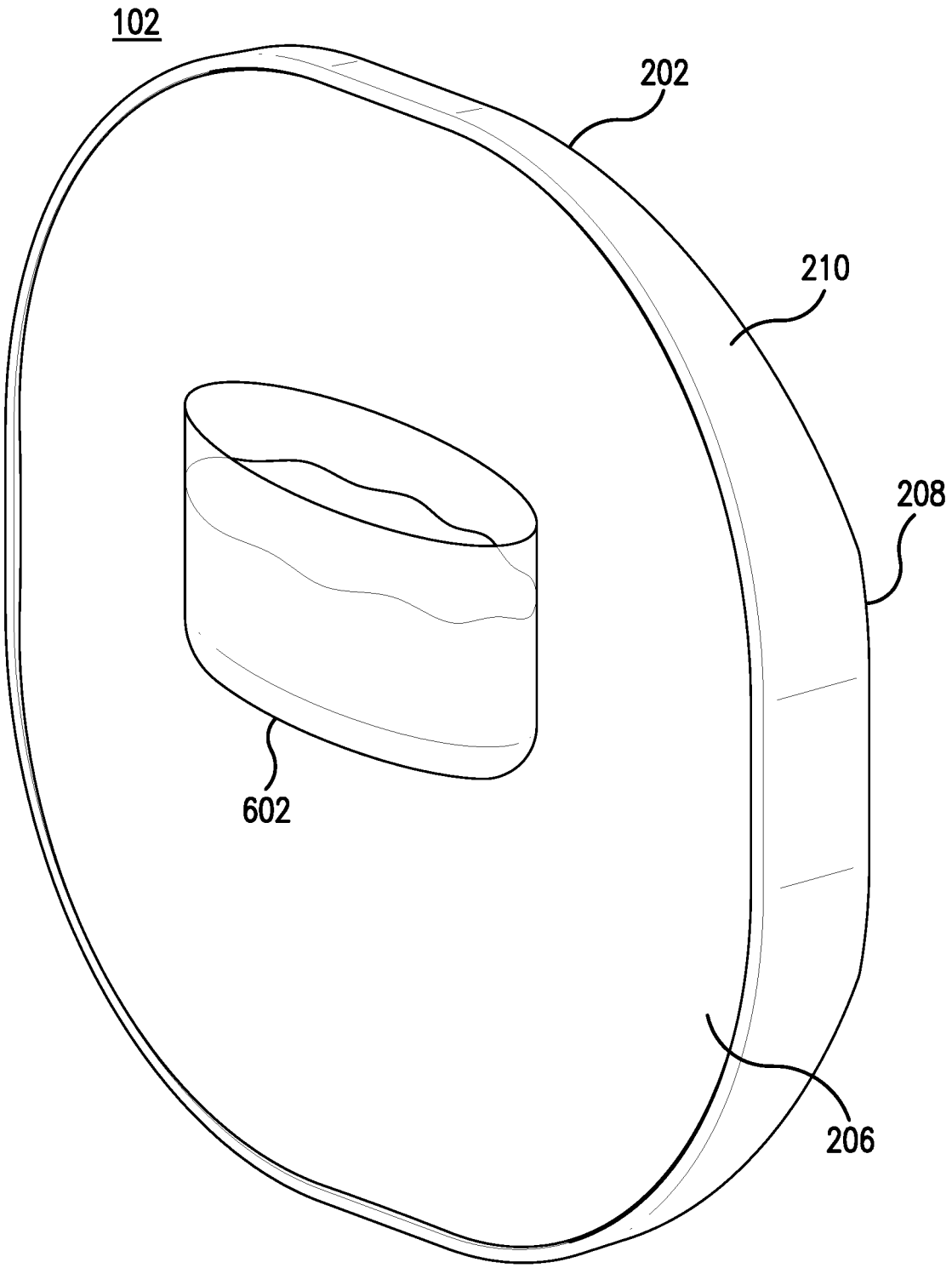
FIG. 6 illustrates an example device in the system of FIG. 1.

As discussed previously, the frame 202 of the device 102 may hold any suitable cosmetic products. FIG. 6 illustrates an example device 102 in the system 100 of FIG. 1. Generally, FIG. 6 shows the device 102 holding a cosmetic container 602. In some embodiments, the device 102 holds the cosmetic container 602 in addition to the mirror. For example, the cosmetic container 602 may be positioned on the mirror. As a result, when the device 102 is attached to a surface, the device 102 may hold and present the cosmetic container 602 to a person looking at the device 102. When the device 102 is tilted on the surface, the device 102 changes the angle at which the cosmetic container 602 is presented to the person.

The cosmetic container 602 may attach to the mirror or to the frame 202 in any suitable manner. For example, the cosmetic container 602 may include an extension that attaches to the frame 202. As another example, the cosmetic container may be formed with the mirror or another solid backing that may be positioned within the frame 202. The cosmetic container 602 may hold any suitable material (e.g., makeup). In some embodiments, the cosmetic container 602 may be open at the top, which allows a person to reach into the cosmetic container 602 and retrieve some of the material within the cosmetic container 602.

Figure 7:
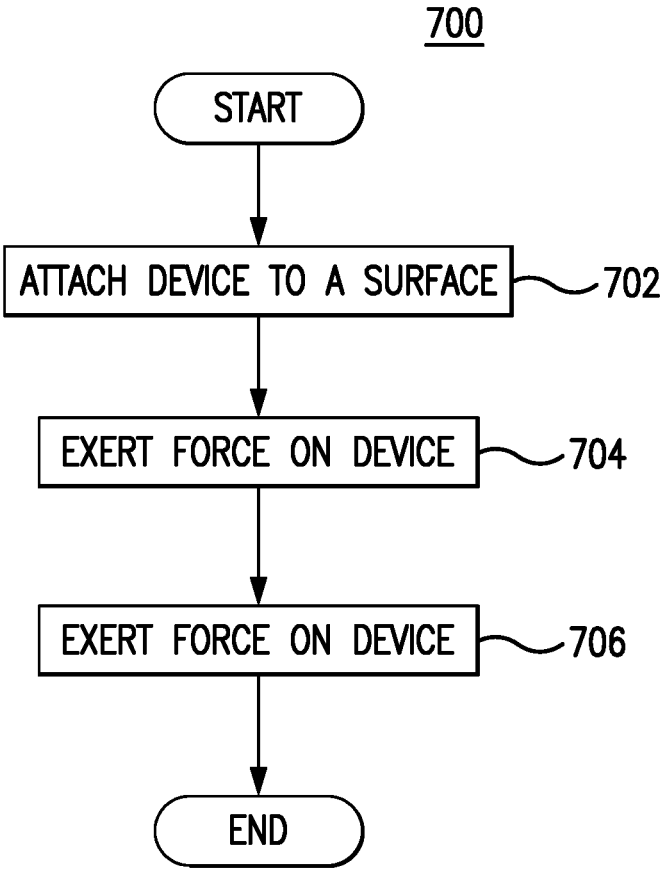
FIG. 7 is a flowchart of an example method performed in the system of FIG. 1.

FIG. 7 is a flowchart of an example method 700 performed in the system 100 of FIG. 1. In certain embodiments, a person using the device 102 performs the method 700. By performing the method 700, the person adjusts the tilt of the device 102 while the device 102 remains attached to a surface.

In block 702, the person attaches the device 102 to a surface. For example, the person may attach the device 102 to a mirror 104 or to another metallic surface. The person may bring the device 102 near the surface. The device 102 may include the portion 302 that then attaches to the surface. For example, the device 102 may include magnets 504 and 510 that magnetically attach the portion 302 to the surface when the portion 302 is brought near to the surface.

In block 704, the person exerts a force on the device 102. For example, the person may exert the force near the portion 304. When the person exerts the force, the portion 302 may detach from or pull away from the surface, and the portion 304 may be brought near the surface. The device 102 may include magnets 502 and 508 that then magnetically attach the portion 304 to the surface. Because the portion 304 is tilted relative to the portion 302, when the portion 304 attaches to the surface, the device 102 tilts.

In block 706, the person exerts a force on the device 102. For example, the person may exert the force near the portion 306. When the person exerts the force, the portion 304 may pull away from or detach from the surface, and the portion 302 may be brought near the surface. The magnets 504 and 510 then magnetically attach the portion 302 to the surface. Because the portion 304 is angled relative to the portion 302, when the portion 302 attaches to the surface, the tilt of the device 102 changes.

In summary, a device 102 includes a tiltable frame 202 that can attach to a larger surface (e.g., a larger mirror 104). Any suitable cosmetic product (e.g., a mirror 204, magnifying mirror, or makeup) may couple to or engage the tiltable frame 202. The tiltable frame 202 includes a back surface 208 with different angled portions 302, 304, and 306. Each of the portions 302, 304, and 306 may attach to the larger surface (e.g., using magnets 502, 504, 506, 508, 510, and 512). A person may exert a force on the device 102 to attach different portions of the back surface 208 to the larger surface. By switching which portion of the back surface 208 is attached to the larger surface, the tiltable frame 202 changes the angle at which device 102 attaches to the larger surface. As a result, when a mirror 104 is engaged with the frame 202, changing the angle at which the device 102 attaches to the larger surface changes the view or perspective provided by the mirror 104. In this manner, the device 102 better assists a person when the person is applying makeup, in certain embodiments.

In the current disclosure, reference is made to various embodiments. However, the scope of the present disclosure is not limited to specific described embodiments. Instead, any combination of the described features and elements, whether related to different embodiments or not, is contemplated to implement and practice contemplated embodiments. Additionally, when elements of the embodiments are described in the form of "at least one of A and B," or "at least one of A or B," it will be understood that embodiments including element A exclusively, including element B exclusively, and including element A and B are each contemplated. Furthermore, although some embodiments disclosed herein may achieve advantages over other possible solutions or over the prior art, whether or not a particular advantage is achieved by a given embodiment is not limiting of the scope of the present disclosure. Thus, the aspects, features, embodiments and advantages disclosed herein are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

In view of the foregoing, the scope of the present disclosure is determined by the claims that follow.

What is claimed is:

1. An apparatus comprising:

a mirror;

a frame, wherein:

the mirror is coupled to the frame to form a front surface;

the frame comprises a back surface opposite the front surface;

the back surface comprises a first portion, a second portion coupled to the first portion, and a third portion coupled to the second portion;

the first portion is angled relative to the second portion; and the third portion is angled relative to the second portion;

a first magnet coupled to the first portion;

a second magnet coupled to the second portion, wherein the second portion is arranged to magnetically attach to a surface using the second magnet such that the frame is in a first position, and wherein the first portion and the third portion are detached from the surface; and a third magnet coupled to the third portion, wherein the first portion is arranged to magnetically attach to the surface using the first magnet such that the frame is in a second position, wherein the second portion and the third portion are detached from the surface, and wherein the frame in the second position is tilted relative to the frame in the first position.

2. The apparatus of claim 1, wherein the frame further comprises a side surface that couples to the front surface and the back surface.

3. The apparatus of claim 1, wherein the mirror is a magnifying mirror.

4. The apparatus of claim 1, wherein an angle of the first portion relative to the second portion is the same as an angle of the third portion relative to the second portion.

5. The apparatus of claim 1, wherein the second portion detaches from the surface and the first portion magnetically attaches by the first magnet to the surface based on a force applied to the mirror or the frame.

6. The apparatus of claim 1, wherein the second portion is positioned between the first portion and the third portion.

7. The apparatus of claim 1, further comprising:

a fourth magnet coupled to the first portion;

a fifth magnet coupled to the second portion; and a sixth magnet coupled to the third portion, wherein the first magnet, the second magnet, the third magnet, the fourth magnet, the fifth magnet, and the sixth magnet are positioned between the mirror and the back surface.

8. An apparatus comprising:

a cosmetic product;

a frame comprising a front surface and a back surface opposite the front surface, wherein:

the cosmetic product is coupled to the front surface;

the back surface comprises a first portion, a second portion coupled to the first portion, and a third portion coupled to the second portion;

the first portion is angled relative to the second portion; and the third portion is angled relative to the second portion;

a first magnet coupled to the first portion;

a second magnet coupled to the second portion, wherein the second portion is arranged to magnetically attach to a surface using the second magnet such that the frame is in a first position, and wherein the first portion and the third portion are detached from the surface; and a third magnet coupled to the third portion, wherein the first portion is arranged to magnetically attach to the surface using the first magnet such that the frame is in a second position, wherein the second portion and the third portion are detached from the surface, and wherein the frame in the second position is tilted relative to the frame in the first position.

9. The apparatus of claim 8, wherein the frame further comprises a side surface that couples to the front surface and the back surface.

10. The apparatus of claim 8, wherein the cosmetic product is a container of makeup.

11. The apparatus of claim 8, wherein an angle of the first portion relative to the second portion is the same as an angle of the third portion relative to the second portion.

12. The apparatus of claim 8, wherein the second portion detaches from the surface and the first portion magnetically attaches by the first magnet to the surface based on a force applied to the cosmetic product or the frame.

13. The apparatus of claim 8, wherein the second portion is positioned between the first portion and the third portion.

14. The apparatus of claim 8, further comprising:

a fourth magnet coupled to the first portion;

a fifth magnet coupled to the second portion; and a sixth magnet coupled to the third portion, wherein the first magnet, the second magnet, the third magnet, the fourth magnet, the fifth magnet, and the sixth magnet are positioned between the cosmetic product and the back surface.

* * * * *